US011666871B2

(12) United States Patent
Greene

(10) Patent No.: US 11,666,871 B2
(45) Date of Patent: Jun. 6, 2023

(54) MIXING HEAD

(71) Applicant: 1887168 Alberta Ltd., Carmangay (CA)

(72) Inventor: Kim Greene, Carmangay (CA)

(73) Assignee: 1887168 ALBERTA LTD., Carmangay (CA)

( * ) Notice: Subject to any disclaimer, the term of this patent is extended or adjusted under 35 U.S.C. 154(b) by 1003 days.

(21) Appl. No.: 16/067,789

(22) PCT Filed: Jan. 6, 2017

(86) PCT No.: PCT/CA2017/050017
§ 371 (c)(1),
(2) Date: Jul. 2, 2018

(87) PCT Pub. No.: WO2017/117682
PCT Pub. Date: Jul. 13, 2017

(65) Prior Publication Data

US 2019/0009227 A1 Jan. 10, 2019

Related U.S. Application Data

(60) Provisional application No. 62/275,649, filed on Jan. 6, 2016.

(51) Int. Cl.
*B01F 5/06* (2006.01)
*B01F 5/04* (2006.01)
(Continued)

(52) U.S. Cl.
CPC .. *B01F 25/43231* (2022.01); *B01F 25/31232* (2022.01); *B01F 25/31233* (2022.01);
(Continued)

(58) Field of Classification Search
CPC ..... B01F 5/064; B01F 5/0642; B01F 5/0645; B01F 25/231; B01F 25/43231;
(Continued)

(56) References Cited

U.S. PATENT DOCUMENTS 4,352,572 A * 10/1982 Chen ..... B01F 25/45 366/148
5,637,469 A * 6/1997 Wilding ..... B01F 15/0264 366/DIG. 3

(Continued)

FOREIGN PATENT DOCUMENTS

| | | |
|---|---|---|
| CA | 2732430 C | 2/2010 |
| CA | 3010347 C | 7/2020 |
| EP | 1900422 A1 | 3/2008 |

OTHER PUBLICATIONS

Canadian Intellectual Property Office, International Search Report, dated Mar. 2, 2017.

*Primary Examiner* — Elizabeth Insler
(74) *Attorney, Agent, or Firm* — Scott Griggs; Griggs Bergen LLP

(57) ABSTRACT

An apparatus and method for mixing fluids, gases and solids together where the apparatus includes at least two mixing head sections that are mirror images of each other and have abutting surfaces that are abutted together. The at least two mixing head sections have a first bore that extends therethrough from an inlet to an outlet, and at least one second bore whose length is longer than the first bore that extends from the inlet to the outlet.

32 Claims, 14 Drawing Sheets

(51) Int. Cl.
*B01F 25/432* (2022.01)
*B01F 25/312* (2022.01)
*B01F 101/49* (2022.01)

(52) U.S. Cl.
CPC .... *B01F 25/31242* (2022.01); *B01F 2101/49* (2022.01); *B01F 2215/0422* (2013.01); *B01F 2215/0431* (2013.01)

(58) Field of Classification Search
CPC ..... B01F 25/4323; B01F 25/31242; B01F 25/31232; B01F 25/31233
See application file for complete search history.

(56) References Cited

U.S. PATENT DOCUMENTS

| | | | | |
|---|---|---|---|---|
| 6,601,613 | B2 * | 8/2003 | McNeely | B01F 5/0403 137/806 |
| 8,132,961 | B1 * | 3/2012 | England | G01F 1/36 366/340 |
| 2008/0087336 | A1 * | 4/2008 | Yasuda | B01F 25/23 137/561 R |
| 2010/0116900 | A1 | 5/2010 | Wurz | |
| 2010/0243953 | A1 | 9/2010 | Livshits | |

* cited by examiner

MIXING HEAD

CROSS-REFERENCE TO RELATED APPLICATIONS

This application is the National Stage of, and therefore, claims the benefit of International Application No. PCT/CA2017/050017 filed on Jan. 6, 2017; which claims priority from U.S. Patent Application Ser. No. 62/275,649 filed on Jan. 6, 2016; both of which are hereby incorporated by reference, in entirety, for all purposes.

TECHNICAL FIELD

The present disclosure is related to the field of devices or mixing heads for mixing gases, fluids and solids into homogenous mixtures, in particular, mixing heads for use in mixing chemicals and water with produced substances from oil and gas productions activities.

BACKGROUND

It is desirable to provide a mixing head for mixing gases, fluids and solids together in an efficient and cost-effective manner.

SUMMARY

A mixing head for mixing fluids together, and a method for using same, is provided.

Broadly stated, in some embodiments, a mixing head can be provided for mixing substances together, the mixing head comprising: a mixing head section comprising an inlet disposed on a first side thereof and an outlet disposed on a second side thereof; a first bore of a first length disposed along a longitudinal axis through the mixing head section between the inlet and the outlet providing communication therebetween; and at least one second bore of a second length disposed through the mixing head section between the inlet and the second side providing communication therebetween, wherein the second length is longer than the first length.

Broadly stated, in some embodiments, the mixing head can further comprise at least two mixing head sections, wherein each mixing head section comprising an abutting surface wherein the abutting surface of one of the at least two mixing head sections is a mirror image of the abutting surface of the other of the at least two mixing head sections, the abutting surfaces configured such that the first bores and the at least one second bores of the at least two mixing head sections are aligned when the at least two mixing head sections are abutted to each other.

Broadly stated, in some embodiments, the mixing head can further comprise at least one third bore of a third length disposed through the body between the inlet and the second side providing communication therebetween, wherein the third length is longer than the second length.

Broadly stated, in some embodiments, the mixing head can further comprise a shear plenum section adjacent to the second side, the shear plenum section comprising a plenum therein substantially aligned with the first bore and the at least one second bore, the shear plenum section comprising at least one shear bore providing communication between the at least one third bore and the plenum.

Broadly stated, in some embodiments, the at least one shear bore can intersect with the plenum at an angle that is substantially perpendicular to the longitudinal axis.

Broadly stated, in some embodiments, the at least one shear bore can intersect with the plenum at an angle that is acute to the longitudinal axis.

Broadly stated, in some embodiments, a cross-sectional area of the at least one second bore can vary as the at least one second bore traverses from the inlet to the second side.

Broadly stated, in some embodiments, one or both of the first bore and the at least one second bore can comprise one or more cross-sectional shapes along their respective lengths from a group comprising of circles, squares, triangles, rectangles, polygons, ovals, ellipses and irregular shapes.

Broadly stated, in some embodiments, the at least one second bore can follow an axis that is askew to the longitudinal axis by an angle.

Broadly stated, in some embodiments, the angle can be less than or equal to 10°.

Broadly stated in some embodiments, the mixing head can further comprise at least two mixing head section disposed in a side by side configuration where the second side of one of the least two mixing head sections is aligned with the first side of another of the at least two mixing head sections, and further separated by a plenum therebetween.

Broadly stated, in some embodiments, one or both of the first bore and the at least one second bore can comprise rifle lands disposed therealong.

Broadly stated, in some embodiments, the mixing head can further comprise a venturi section disposed between the at least two mixing head sections, the venturi section comprising an annular gap for providing communication between the at least two mixing head sections, the venturi section further comprising at least one injection port providing communication between the annular gap and a second source of the substances to be injected into the mixing head.

Broadly stated, in some embodiments, the mixing head can further comprise wear surface coating disposed at least partially on surfaces within the inlet and within the at least one second bore.

Broadly stated, in some embodiments, the mixing head can further comprise at least two of the at least one second bore at least partially intersecting with each other within the mixing head section.

Broadly stated, in some embodiments, the mixing head can further comprise at least two sets of the at least two mixing head sections configured in a side by side configuration.

Broadly stated, in some embodiments, the mixing head can further comprise an insert section disposed in between a pair of the at least two sets of the at least two mixing head sections.

Broadly stated, in some embodiments, the mixing head can further comprise at least two mixing head section disposed in a side by side configuration where the second side of one of the least two mixing head sections is aligned with the first side of another of the at least two mixing head sections, and further separated by a plenum therebetween.

Broadly stated, in some embodiments, one or both of the first bore and the at least one second bore can comprise rifle lands disposed therealong.

Broadly stated, in some embodiments, the mixing head can further comprise a venturi section disposed between the at least two mixing head sections, the venturi section comprising an annular gap for providing communication between the at least two mixing head sections, the venturi section further comprising at least one injection port providing communication between the annular gap and a second source of the substances to be injected into the mixing head.

Broadly stated, in some embodiments, the mixing head can further comprise wear surface coating disposed at least partially on surfaces within the inlet and within the at least one second bore.

Broadly stated, in some embodiments, the mixing head can comprise at least two of the at least one second bore at least partially intersecting with each other within the mixing head section.

Broadly stated, in some embodiments, the mixing head can comprise at least two sets of the at least two mixing head sections disposed in a side by side configuration.

Broadly stated, in some embodiments, the mixing head can further comprise an insert section disposed in between a pair of the at least two sets of the at least two mixing head sections.

Broadly stated, in some embodiments, the insert section can further comprise at least one injection port providing communication between the annular gap and a second source of the substances to be injected into the mixing head.

Broadly stated, in some embodiments, the mixing head can be disposed in a pipe.

Broadly stated, in some embodiments, one or both of the first bore and the at least one second bore can comprise a helical configuration.

Broadly stated, in some embodiments, a method can be provided for mixing substances together, the method comprising the steps of: providing a mixing head configured for passing the substances through, the mixing head comprising: a body comprising an inlet disposed on a first side thereof and an outlet disposed on a second side thereof, a first bore of a first length disposed along a longitudinal axis through the body between the inlet and the outlet providing communication therebetween, and at least one second bore of a second length disposed through the body between the inlet and the second side providing communication therebetween, wherein the second length is longer than the first length; pumping the substances into the inlet; and receiving mixed substances from the second side.

Broadly stated, in some embodiments, the method can further comprise the step of pumping the substances through a venturi section before entering the inlet, and injecting a second source of the substances into the venturi section.

Broadly stated, in some embodiments, the method can further comprise the step of passing the mixed substances through a shear plenum section comprising a plenum therein substantially aligned with the first bore and the at least one second bore, the shear plenum section comprising at least one shear bore providing communication between the at least one third bore and the plenum.

Broadly stated, in some embodiments, the substances can comprise one or more of gases, liquids and solids.

DETAILED DESCRIPTION OF EMBODIMENTS

Figure 1:
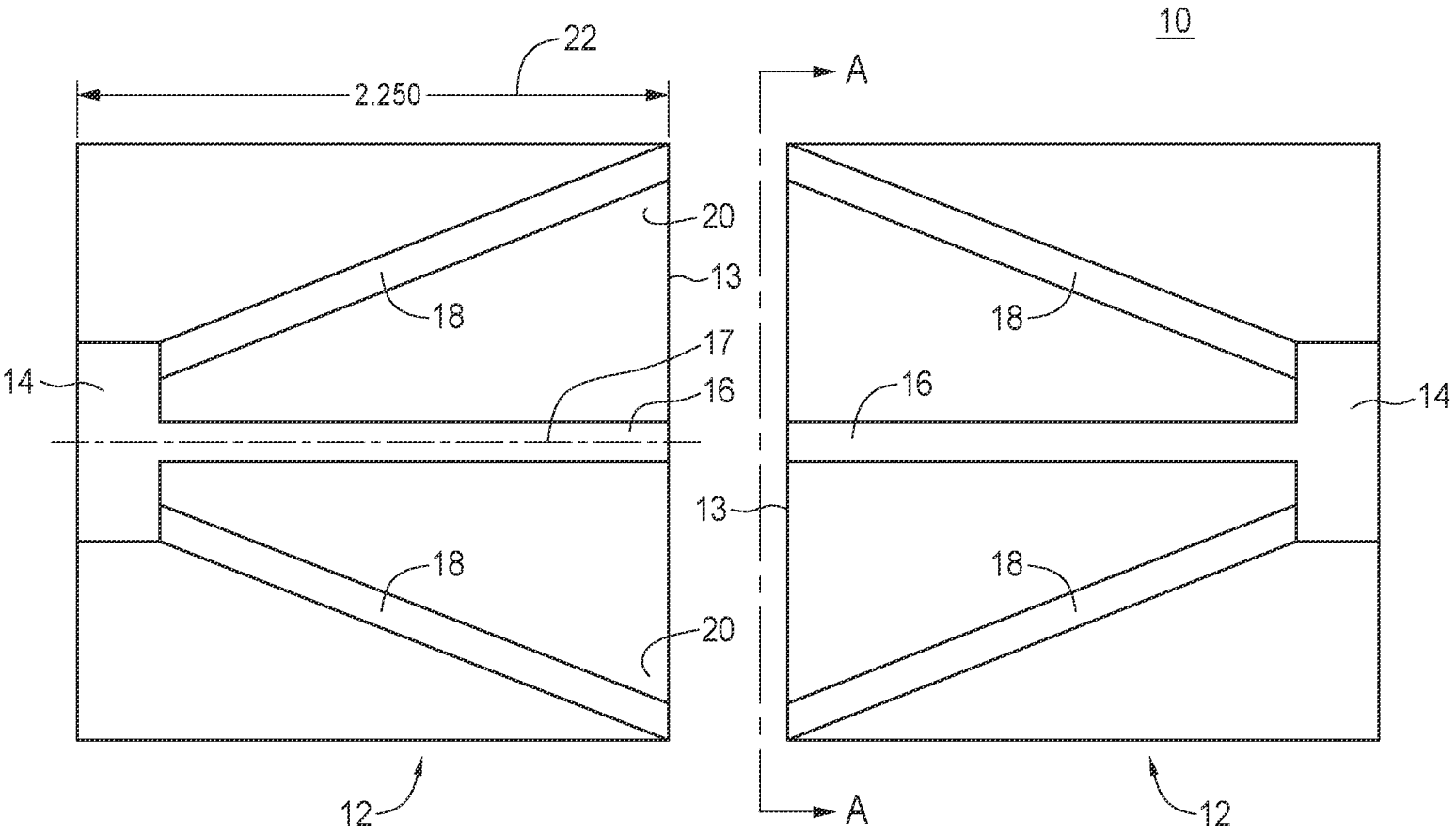
FIG. 1 is a side elevation cross-section view depicting two mixing head sections to form one embodiment of a mixing head.

Referring to FIG. 1, one embodiment of mixing head 10 is shown. In one embodiment, mixing head 10 can comprise two mixing head sections 12, which can be identical or mirror images of each other. In some embodiments, each mixing head section 12 can comprise abutting surface 13 and opening 14, which can be an inlet or an outlet depending on which direction fluids pass through mixing head 10.

In some embodiments, mixing head section 12 can comprise first or central bore 16 providing communication along a longitudinal axis 17 from opening 14 to abutting surface 13. Each mixing section 12 can further comprise at least one second or divergent bore 18 providing communication from opening 14 to abutting surface 13, wherein the at least one divergent bore 18 is longer than central bore 16. Mixing head sections 12 can be configured such that central bore 16 and the at least one divergent bore 18 are aligned when mixing head sections 12 are abutted together along their respective abutting surface 13.

Figure 2:
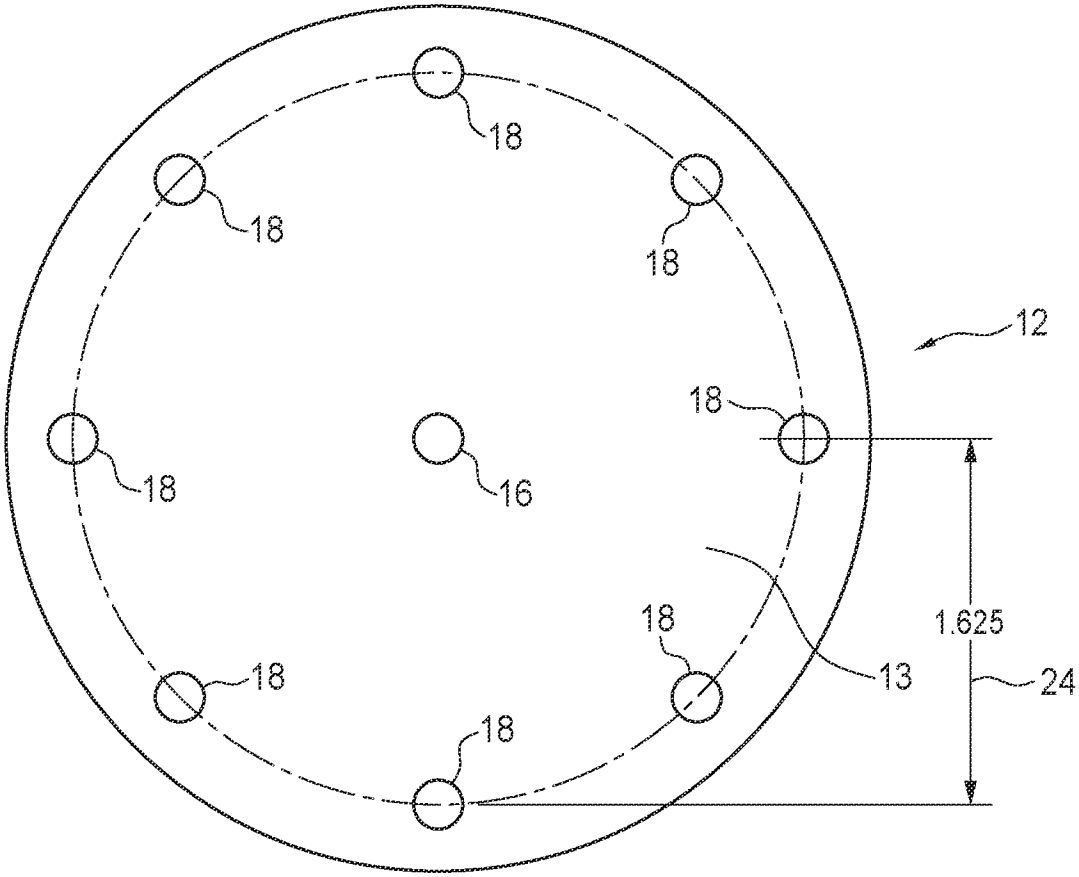
FIG. 2 is an end elevation view depicting the mixing head section of FIG. 1 along section lines A-A.
Figure 3:
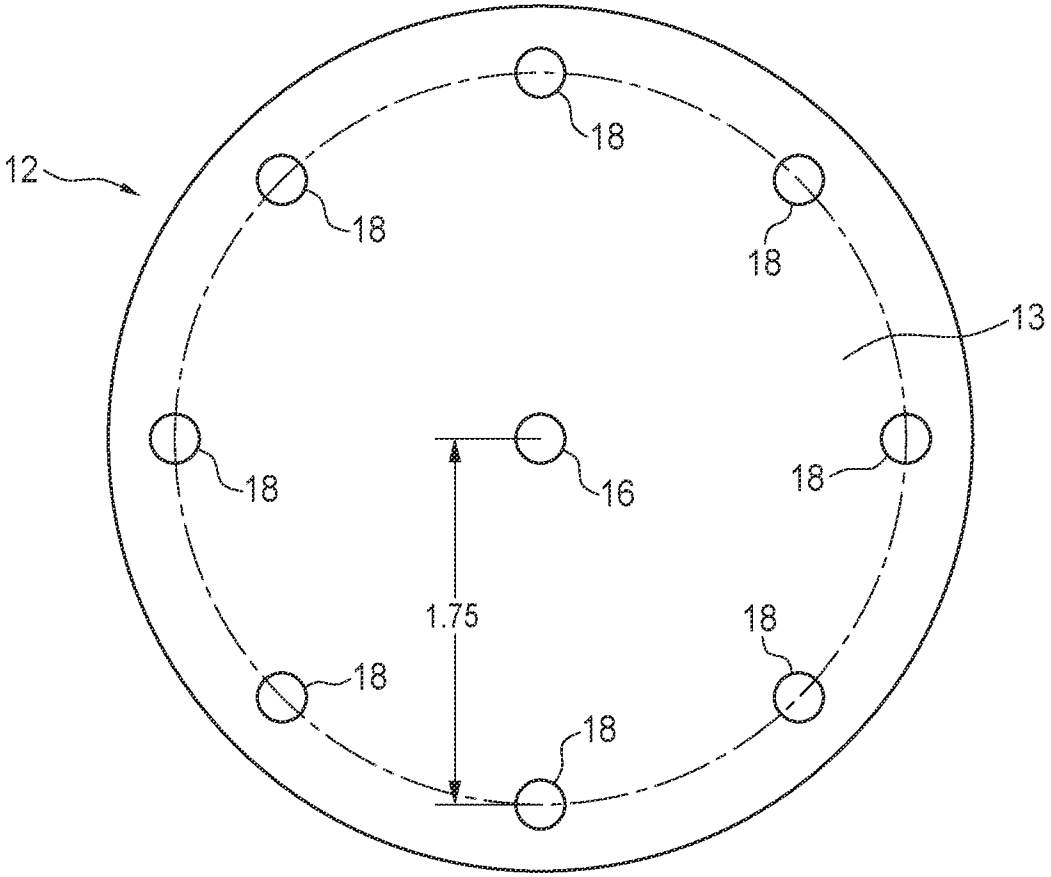
FIG. 3 is an end elevation view depicting a second embodiment of the mixing head section of FIG. 2.

Referring to FIGS. 2 and 3, end views of abutting surface 13 are shown. In FIG. 2, a mixing head section 12 for use in 4 inch diameter pipe is shown, wherein a plurality of divergent bores 18 are spaced circumferentially apart in a circle having a radius of 1.625 inches around first bore 16. In FIG. 3, a mixing head section 12 for use in 6 inch diameter pipe is shown, wherein a plurality of divergent bores 18 are spaced circumferentially apart in a circle having a radius of 1.75 inches around central bore 16.

When used in 4 inch pipe, opening 14 can be configured with a 1.5 inch NPT fitting, as well known to those skilled in the art. When used in 6 inch pipe, opening 14 can be configured with a 2 inch NPT fitting, as well known to those skilled in the art. In other embodiments, mixing head 10 can be scaled up or down in size as obvious to those skilled in the art, wherein opening 14 can range in size to accommodate a 0.25 inch NPT fitting for 1 inch pipe application, and can be increased in size for larger diameter pipes.

In some embodiments, central bore 16 can comprise a diameter of 0.375 inches, and divergent bore 18 can comprise a diameter of 0.5 inches. In some embodiments, each mixing head section 12 can comprise eight divergent bores 18 disposed circumferentially around central bore 16. In some embodiments, divergent bores 18 can be disposed through mixing head section 12 at angle 20 relative to abutting surface 13. In some embodiments, angle 20 can be approximately 40°.

Figure 4:
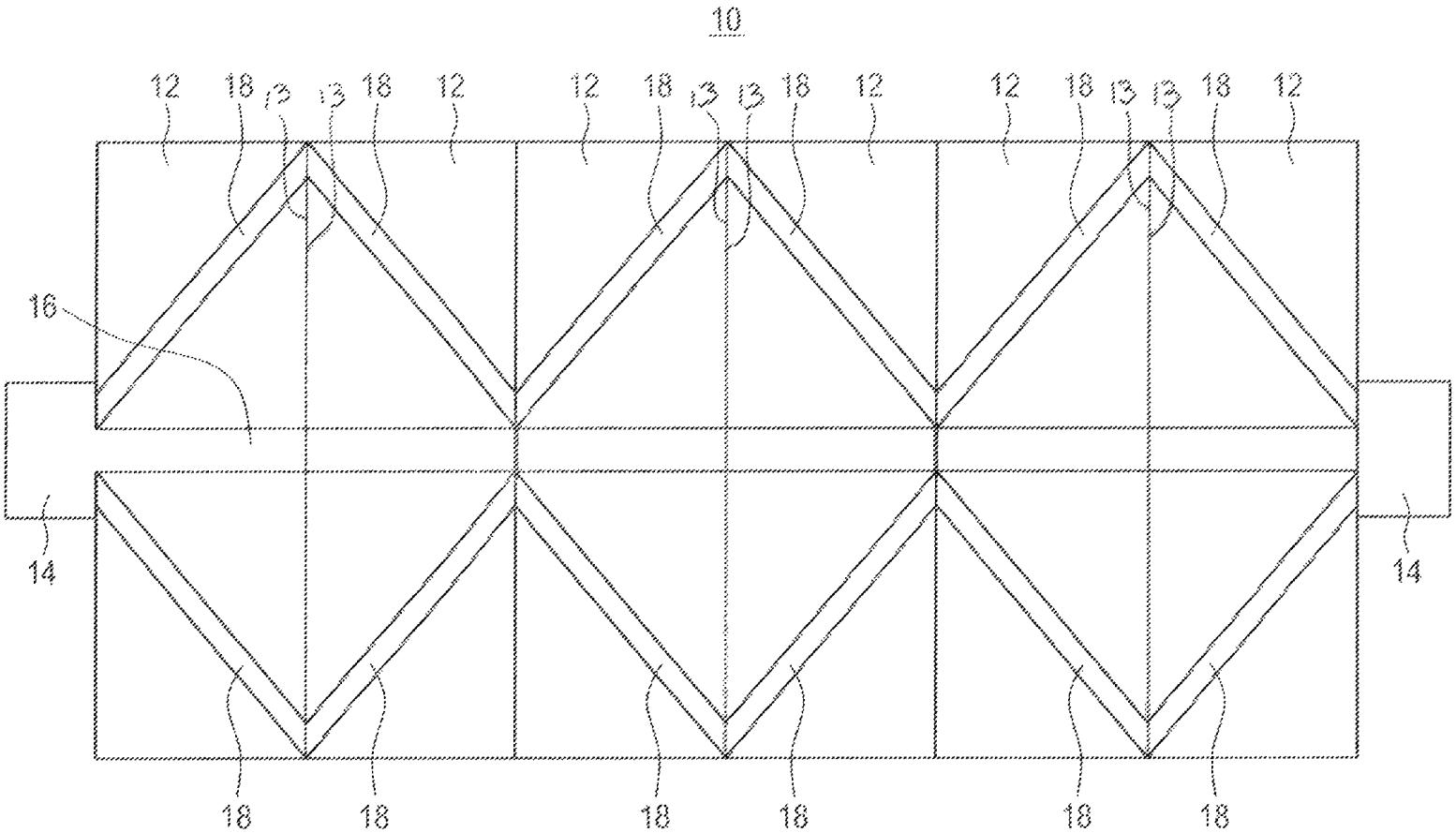
FIG. 4 is a side elevation cross-section view depicting a third embodiment of the mixing head of FIG. 1, having six mixing head sections.

Referring to FIG. 4, six mixing head sections 12 are shown abutted together to form one embodiment of mixing head 10. At a minimum, two mixing head sections 12 abutted together to form mixing head 10, although any even number of mixing head sections 12 can be abutted together to form mixing head 10. In some embodiments, a plurality of mixing head sections 12 can be placed inside a sleeve (not shown) to hold the mixing head sections in place.

In operation, fluids to be mixed together can injected into opening 14 on one end of mixing head 10, wherein the fluids pass through the first and second bores mixing and intersecting with each other as the fluids traverse through the mixing head sections until they reach opening 14 on the other end of mixing head 10. In some embodiments, fluids can first enter a manifold (not shown) or fluid injecting unit (not shown) before entering opening 14.

In one application, mixing head 10 can be used to mix oil sludge with water and chemical. In another application, mixing head 10 can be used to evenly distribute or mix immiscible constituents together.

Figure 5:
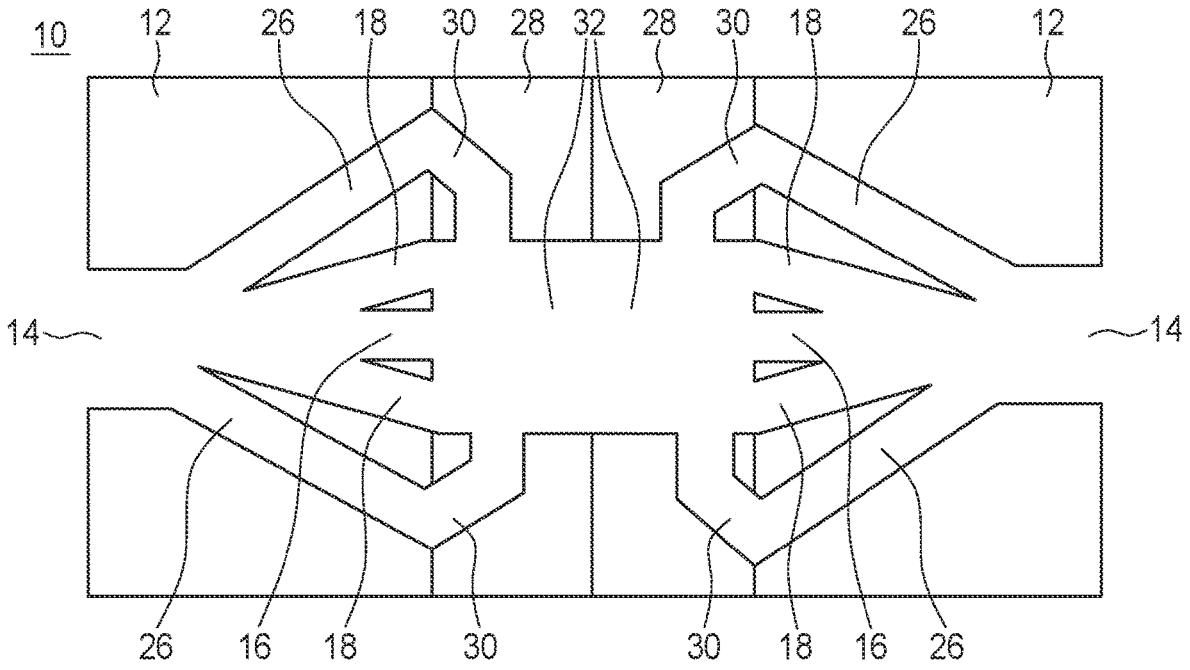
FIG. 5 is a side elevation cross-section view depicting a fourth embodiment of the mixing head of FIG. 1, having interstitial 90° shear plenum sections.
Figure 6:
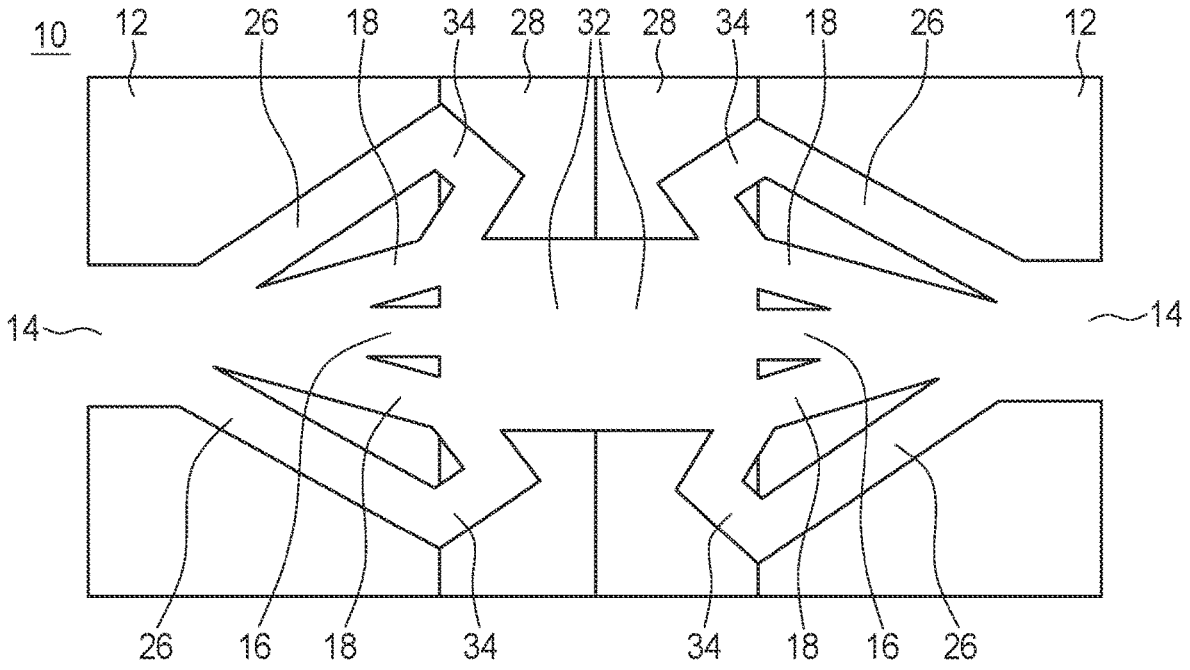
FIG. 6 is a side elevation cross-section view depicting a fifth embodiment of the mixing head of FIG. 1, having interstitial negative-angle shear plenum sections.

Referring to FIGS. 5 and 6, other embodiments of mixing head 10 are shown. In some embodiments, mixing head 10 can comprise shear plenum section 28 disposed adjacent to mixing head section 12 wherein central bore 16 and divergent bores 18 can align with plenum 32 disposed in shear plenum section 28. In these embodiments, mixing head section 12 can further comprise divergent bores 26 that can align with shear bores disposed in shear plenum section 28. In FIG. 5, shear plenum section 28 can comprise shear bores 30 that can provide a shear path in plenum 32 that is approximately 90° to the longitudinal path through mixing head 10. In FIG. 6, shear plenum section 28 can comprise shear bores 34 that can provide a "negative angle" path into plenum 32 that is partially opposite to the longitudinal path through mixing head 10. By providing a mixing head 10 as shown in FIG. 5 or 6, a higher shear force can be obtained in a smaller space or volume. In so doing, however, there can be a loss in pressure of fluids passing through mixing head 10. As an example, without shear plenum sections 28, mixing head 10 can be configured to pass fluids therethrough at a flow rate of 45 to 75 gallons per minute ("GPM") with 1 to 2 pounds per square inch ("psi") loss of pressure in the fluids from input to output of mixing head 10. By inserting shear plenum sections 28 into mixing head 10, a 45 GPM flow rate of fluids through mixing head 10 can experience a pressure drop of approximately 20 psi from input to output. These embodiments of mixing head 10 can be used in the manufacture of high performance coatings, such as ceramic coatings, where a degree of shear mixing is required in short period of time as the hardeners used in such coatings set up very quickly, time-wise, thus requiring thorough mixing of the sub-components of the coating just prior to application onto a surface where the hardeners set up the coating shortly after being applied onto the surface.

Figure 7:
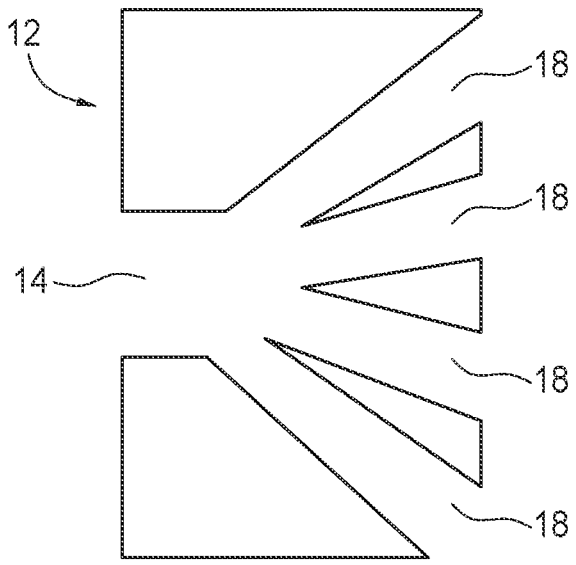
FIG. 7 is a side elevation cross-section view depicting an alternate embodiment of the mixing head section of FIG. 1.

Referring to the FIG. 7, alternate embodiments of mixing head section 12 can comprise divergent bores 18 that can taper in diameter, either increasing in diameter as divergent bores 18 move away from central bore 16 or decreasing in diameter as divergent bores 18 move away from central bore 16, all as means to increase shear on the fluids passing therethrough and, thus, the mixing of sub-components within the fluids.

Figure 8A:
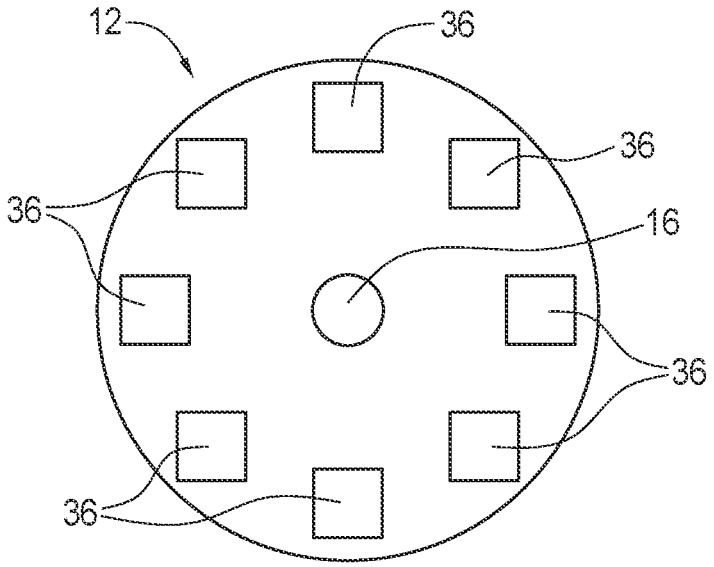
FIG. 8A is an end elevation view depicting an embodiment of the mixing head section of FIG. 2 comprising square-shaped divergent bores.
Figure 8B:
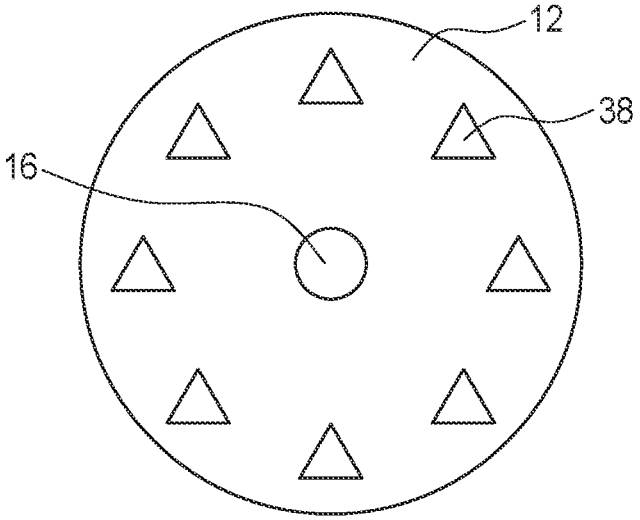
FIG. 8B is an end elevation view depicting an embodiment of the mixing head section of FIG. 2 comprising triangle-shaped divergent bores.
Figure 8C:
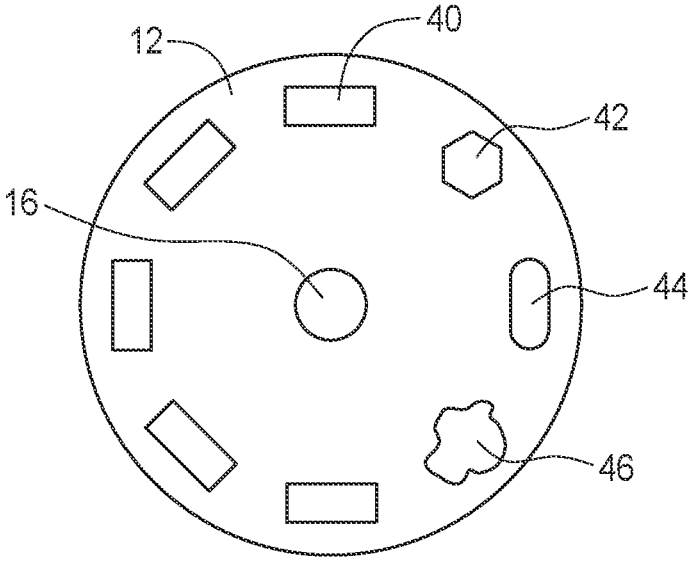
FIG. 8C is an end elevation view depicting an embodiment of the mixing head section of FIG. 2 comprising various shaped divergent bores, include rectangular-shaped, polygonal-shaped, elliptical-shaped and irregular-shaped divergent bores.

Referring to FIGS. 8A, 8B and 8C, alternate embodiments of mixing head section 12 are shown. In some embodiments, the divergent pathways through mixing head section 12 can comprise a square cross-section, shown as reference numeral 36 in FIG. 8A. In some embodiments, the divergent pathways through mixing head section 12 can comprise a triangular cross-section, shown as reference numeral 38 in FIG. 8B. In some embodiments, the divergent pathways through mixing head section 12 can comprise a rectangular cross-section, shown as reference numeral 40 in FIG. 8C. In some embodiments, the divergent pathways through mixing head section 12 can comprise a polygonal cross-section, shown as reference numeral 42 in FIG. 8C. In some embodiments, the divergent pathways through mixing head section 12 can comprise an oval or elliptical cross-section, shown as reference numeral 44 in FIG. 8C. In some embodiments, the divergent pathways through mixing head section 12 can comprise an irregular cross-section, shown as reference numeral 46 in FIG. 8C. The selection of the cross-section of the divergent paths being one of a design choice depending on the application of mixing head 10.

Figure 9A:
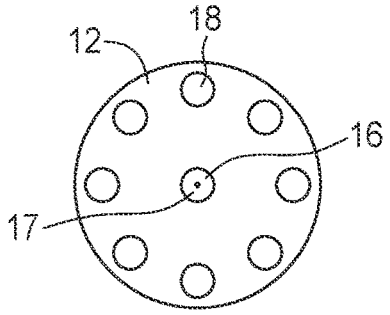
FIG. 9A is an end elevation view depicting a mixing head section comprising divergent bores following a compound angled-path through the mixing head section, viewed from the inlet side.
Figure 9B:
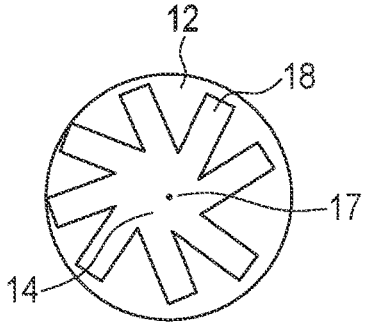
FIG. 9B is an end elevation view depicting the mixing head section of FIG. 9A comprising divergent bores following a compound angled-path through the mixing head section, viewed from the outlet side.

Referring to FIGS. 9A and 9B, another embodiment of mixing head section 12 is shown. In this embodiment, divergent bores 18 can follow a path from an inlet side, as shown in FIG. 9A, along an axis that is askew relative to longitudinal axis 17 by an angle such that divergent bores 18 can "twist" around central bore 16 to converge into opening 14 on an outlet side, as shown in FIG. 9B. In some embodiments, the angle can be up to 10°.

Figure 10:
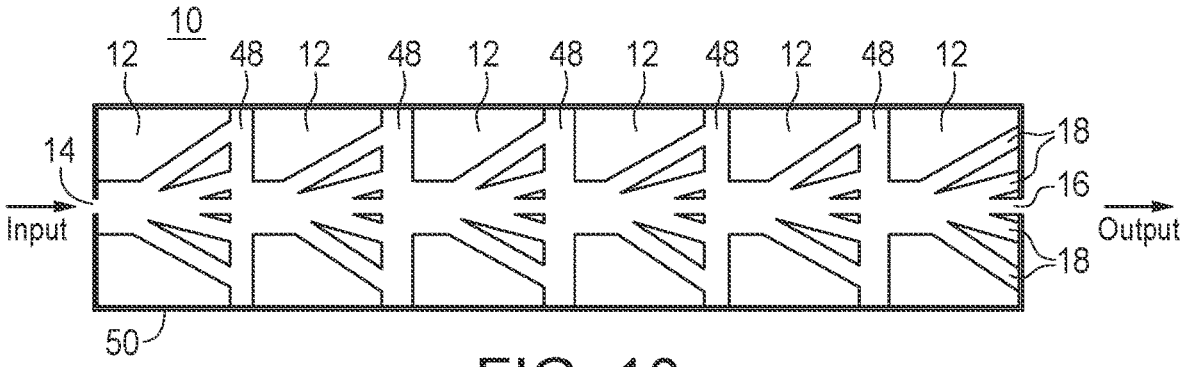
FIG. 10 is a side elevation cross-section view depicting a plurality of mixing head sections disposed in a pipe, the mixing head sections separated by a plenum.

Referring to FIG. 10, in some embodiments, mixing head 10 can comprise a plurality of mixing head sections 12 disposed in pipe 50, each pair of adjacent mixing head sections 12 separated by plenum 48. This embodiment can function similarly to a 90° shear configuration, as shown in FIG. 5. In some embodiments, mixing head 10 can be used for adding polymers to a fluid to produce a homogenously mixed fluid. Drilling fluids or muds are one such example.

Figure 11A:
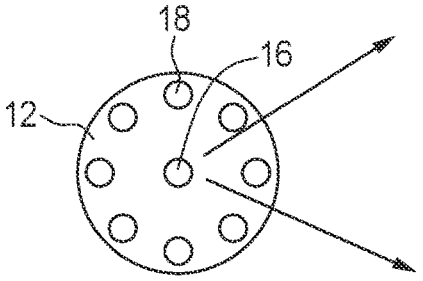
FIG. 11A is an end elevation view depicting one embodiment of the mixing head section of FIG. 1 comprising a central bore with rifle lands.
Figure 11B:
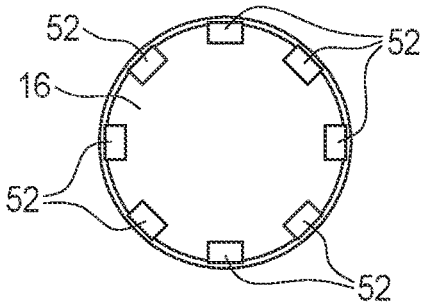
FIG. 11B is an end elevation view depicting the central bore of the mixing head section of FIG. 11A.

Referring to FIGS. 11A and 11B, in some embodiments, rifle lands 52 can be added to interior surfaces of one or more of central bore 16 and divergent bores 18 to introduce rotation or spinning of fluid streams passing therethrough. Rifle lands can be placed within one or more bores as a means to create shear between streams of fluids. In some embodiments where rifle lands 52 are disposed in more than one bore, rotation of individual fluid stream can be the same for all rifled bores or can be mixed up where some fluid streams can rotate in a clockwise rotation whereas others can rotated in a counter-clockwise rotation, all of which can be used to introduce a strong shear effect between the fluid streams.

Figure 12A:
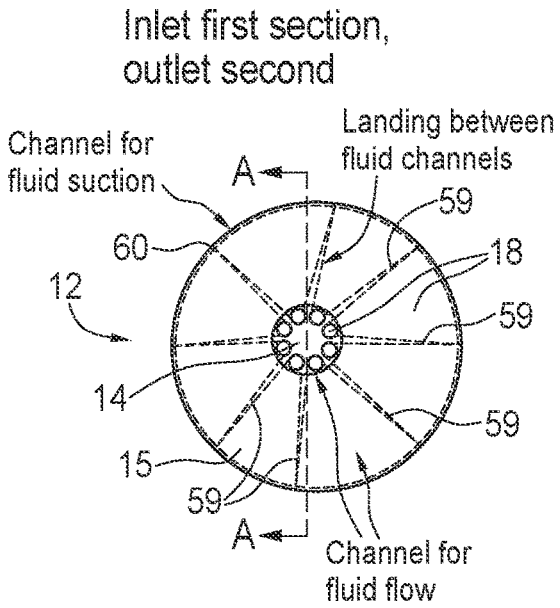
FIG. 12A is an end elevation cross-section view depicting a mixing head comprising a venturi-effect injection section.
Figure 12B:
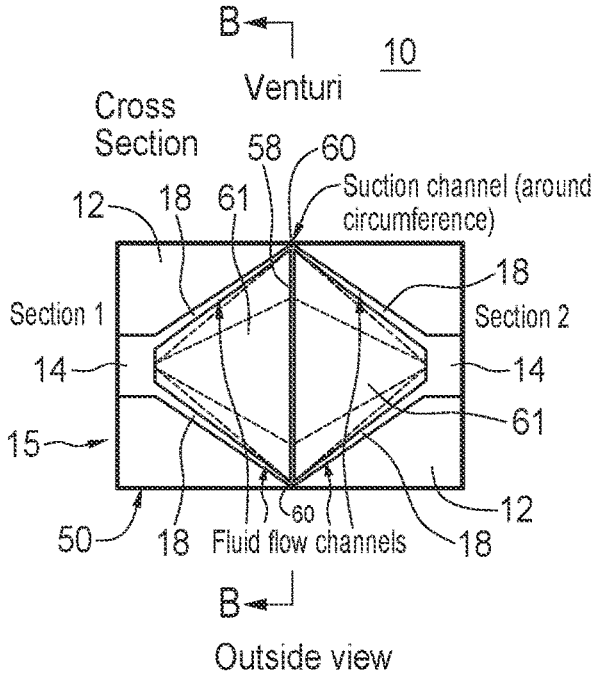
FIG. 12B is a side cross-section elevation view depicting the mixing head of FIG. 12A along section lines A-A.
Figure 12C:
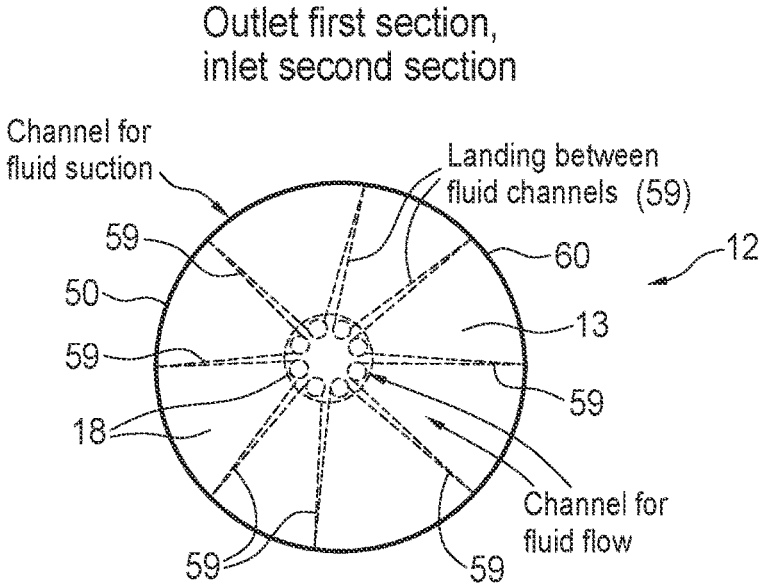
FIG. 12C is an end elevation view depicting the mixing head of FIG. 12B along section lines B-B.

Referring to FIGS. 12A, 12B and 12C, in some embodiments, mixing head sections 12 can be used as a venturi. In such embodiments, divergent bores 18 can narrow in height but broaden in width as they extend away from opening 14 towards venturi gap 58 disposed between a pair of such mixing head sections 12, thus forming lands 59 to support section 61 within mixing head section 12. In such a configuration, fluids can increase in velocity passing through venturi gap 58 due to a Venturi effect. In some embodiments, mixing head 10 can further comprise one or more injection ports 60 to enable the injection of gases or fluids therethrough into venturi gap 58 to be mixed with the fluid flowing through the mixing head by being drawn into venturi gap 58 due to the Venturi effect. In some embodiments, injection port 60 can comprise a continuous slit or gap disposed circumferentially about pipe 50 adjacent to venturi gap 58.

Figure 12D:
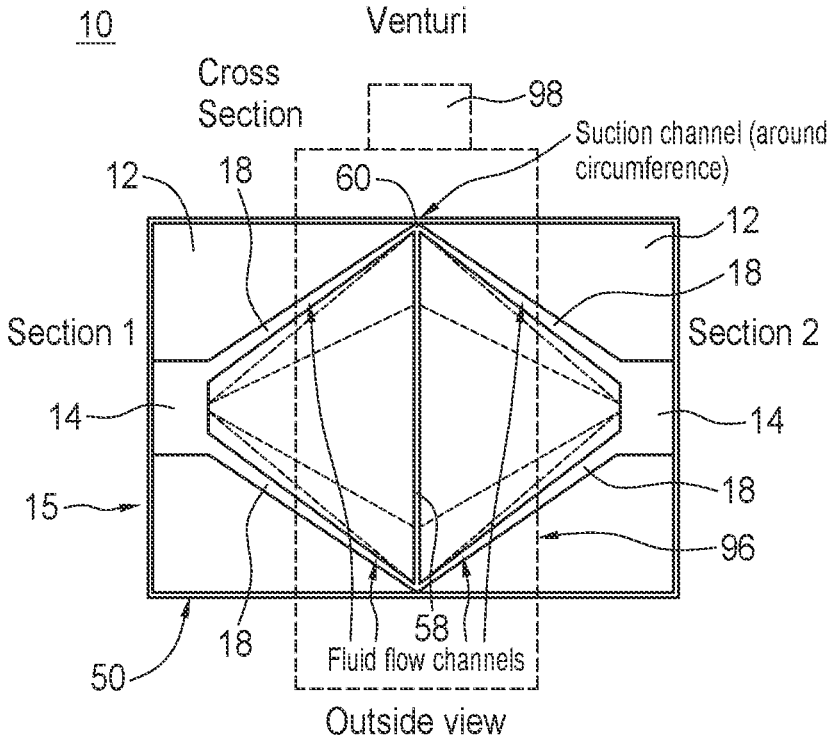
FIG. 12D is a side cross-section elevation view depicting the mixing head of FIG. 12B further comprising an injection sleeve disposed around thereof.
Figure 12E:
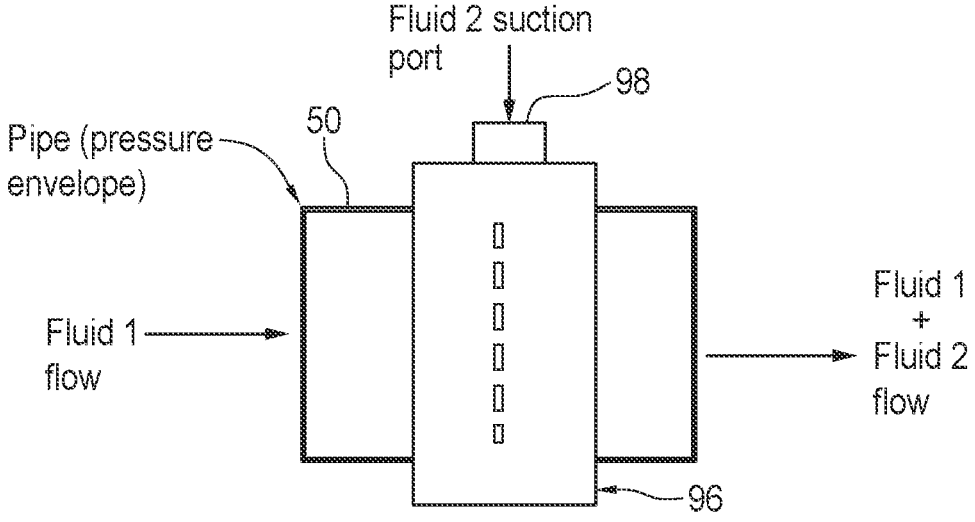
FIG. 12E is a side elevation view depicting the injection sleeve of FIG. 12D.

Referring to FIGS. 12D and 12E, another embodiment of mixing head 10 having a venturi effect is shown. In this embodiment, mixing head 10 can comprise injection sleeve 96 disposed circumferentially around pipe 50 adjacent to venturi gap 58 and injection port 60, thus coupling the left and right sections (as shown in FIG. 12D) of mixing head 10 together. Injection sleeve 96 can further comprise injection port 98 that can be in communication with venturi gap 58 via injection port 60. In this embodiment, fluids or gases can be injected into mixing head 10 via injection port 98 due to the venturi effect caused by fluids flowing through mixing head 10.

Figure 12F:
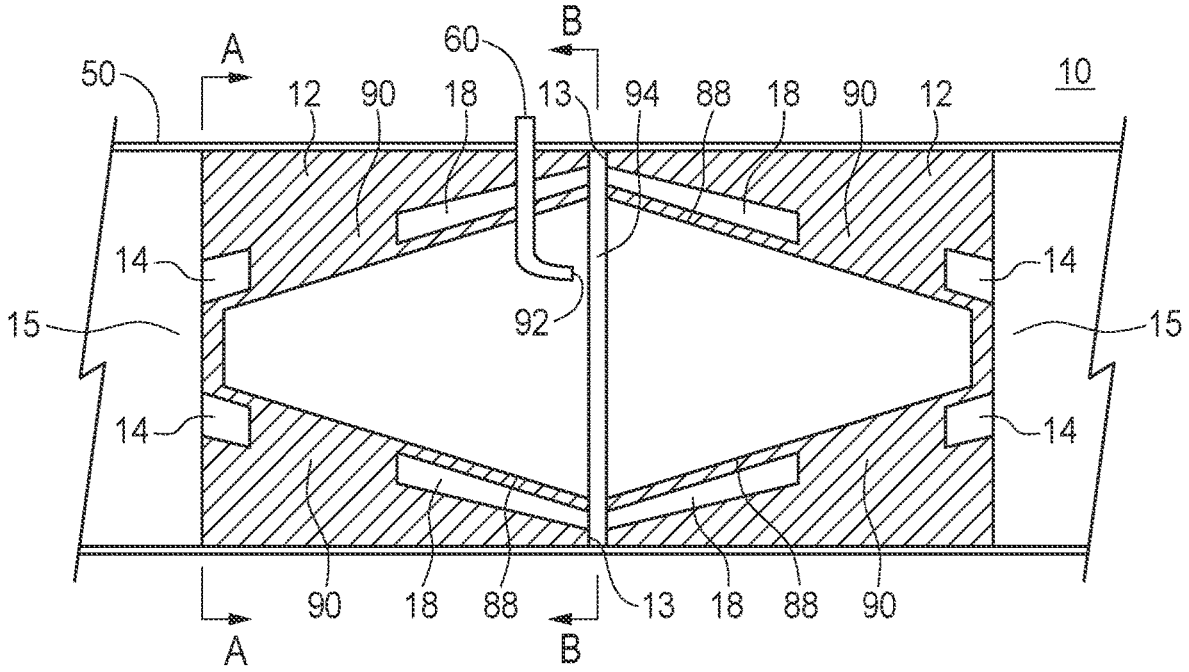
FIG. 12F is a side cross-section elevation view depicting an alternate embodiment of a mixing head comprising a venturi-effect injection section.
Figure 12G:
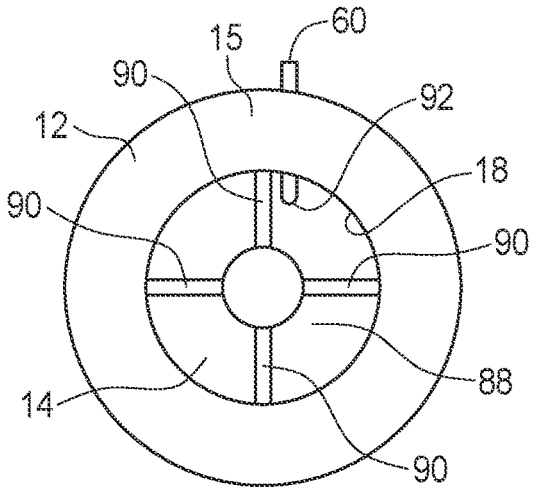
FIG. 12G is an end elevation view depicting the mixing head of FIG. 12F along section lines A-A.
Figure 12H:
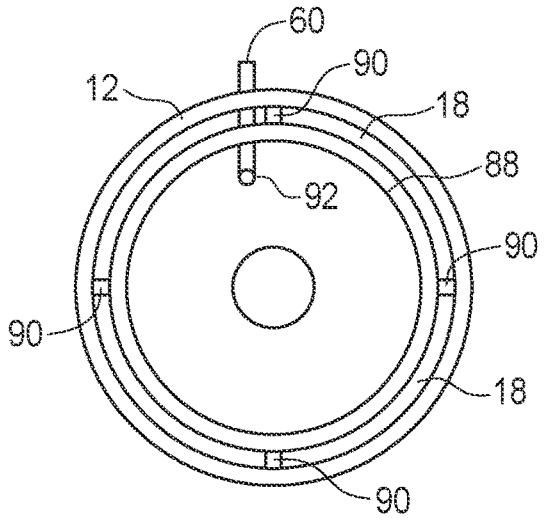
FIG. 12H is an end elevation view depicting the mixing head of FIG. 12F along section lines B-B.

Referring to FIGS. 12F, 12G and 12H, another embodiment of mixing head 10 having a venturi effect is shown. In this embodiment, mixing head section 12 can comprise cone 88 disposed therein, supported by lands 90 disposed therebetween, thus causing divergent bores 18 to narrow in cross-section area they extend away from opening 14 towards venturi gap 94 disposed between a pair of such mixing head sections 12. This can cause fluids or gases to increase in velocity as they pass across venturi gap 94, thus causing a low pressure condition therein. In some embodiments, mixing head can further comprise injection pipe 92 disposed through the sidewalls of mixing head section 12 and cone 88 from injection port 60 to the interior of mixing head 10 adjacent to venturi gap 94. As such, the low pressure condition within venturi gap 94 as fluids or gases pass through mixing head 10 can draw in injected fluids or gases from injection port 60 via injection pipe 92.

Figure 13:
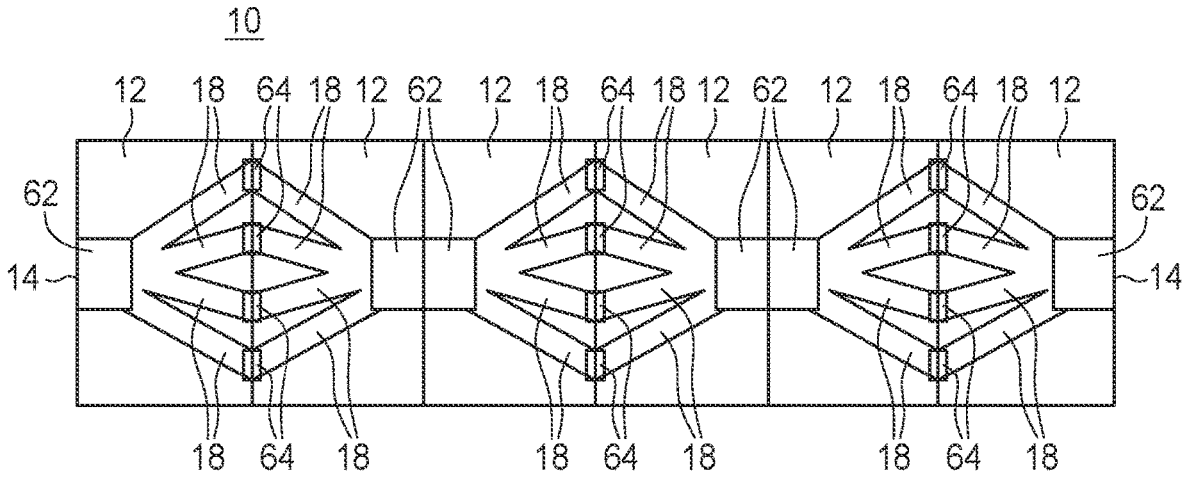
FIG. 13 is a side elevation view depicting a mixing head having six mixing head sections with hardened wear coatings applied to surfaces that are subject to wear.

Referring to FIG. 13, in some embodiments, surfaces 62 and 64 of mixing head 10 can be hardened with coatings to reduce or minimize the wear on these surfaces caused by fluids or solids flowing through mixing head 10, such as sand being mixed with fluids for fracking of wells. These coatings can include one or more tungsten carbide, ceramic coatings and other wear-resistant coatings as well known to those skilled in the art.

Figure 14:
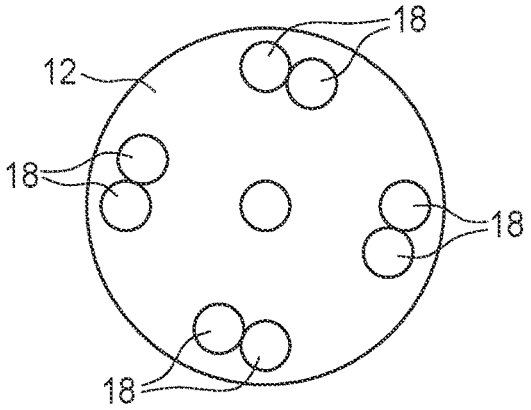
FIG. 14 is an end elevation view depicting an embodiment of a mixing head section where divergent bores impinge each other near the perimeter of the mixing head section.

Referring to FIG. 14, in some embodiments, adjacent divergent bores 18 can merge or impinge upon each other as a means to provide additional shearing of fluids passing through mixing head section 12.

Figure 15:
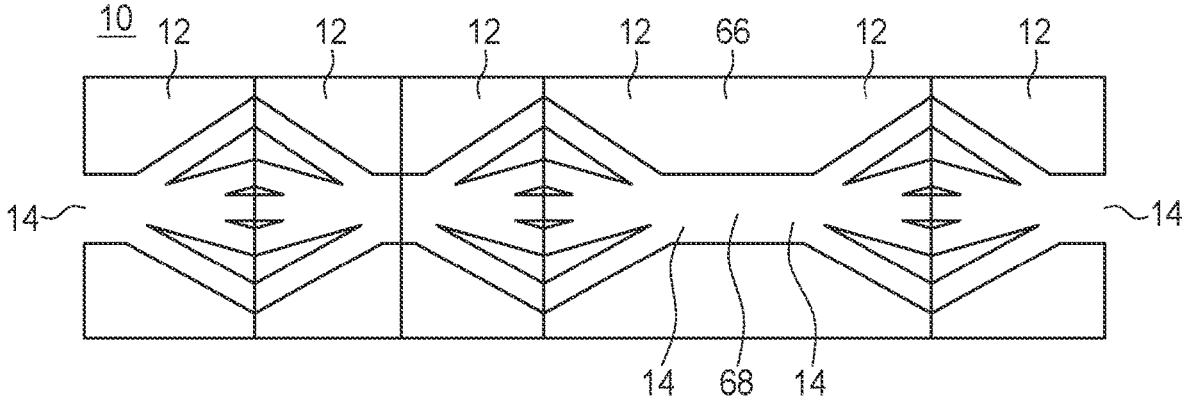
FIG. 15 is a side elevation view depicting an embodiment of a mixing head comprising an extension section having a reaction plenum disposed therein.

Referring to FIG. 15, in some embodiments, mixing head 10 can comprise one or more spacer sections 66 disposed between adjacent mixing head sections 12, wherein each spacer section 66 can comprise passageway 68 to provide communication between openings 14 of the adjacent mixing head sections. By providing spacer section 66 disposed between adjacent mixing head sections, the space provided by passageway 68, and the time required for mixed fluids to traverse passageway 68, can permit reactions within the mixed fluids to occur after exiting one mixing head section and before entering another mixing head section.

Figure 16:
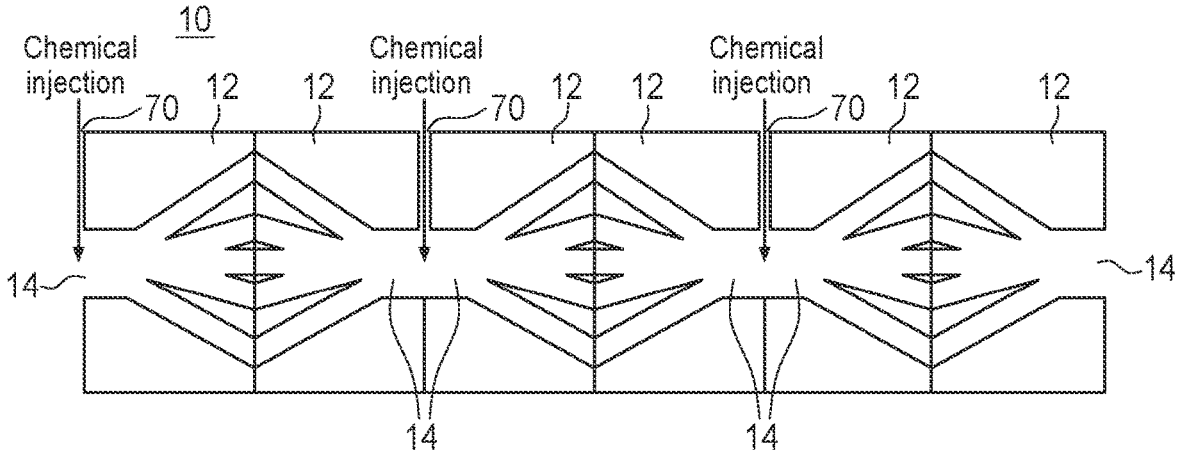
FIG. 16 is a side elevation view depicting an embodiment of a mixing head comprising multiple injection ports.

Referring to FIG. 16, in some embodiments, mixing head 10 can comprise one or more injection ports 70 for injection additional fluids or gases into the fluids passing through mixing head 10. In some embodiments, injection ports 70 can provide communication to openings 14 disposed between adjacent mixing head sections 12. In some embodiments, the spacing between injection ports 70 can permit reactions with a first injected gas or fluid to take place while passing through one or more mixing head sections 12 before reactions occur with a second injected gas or fluid.

Figure 17:
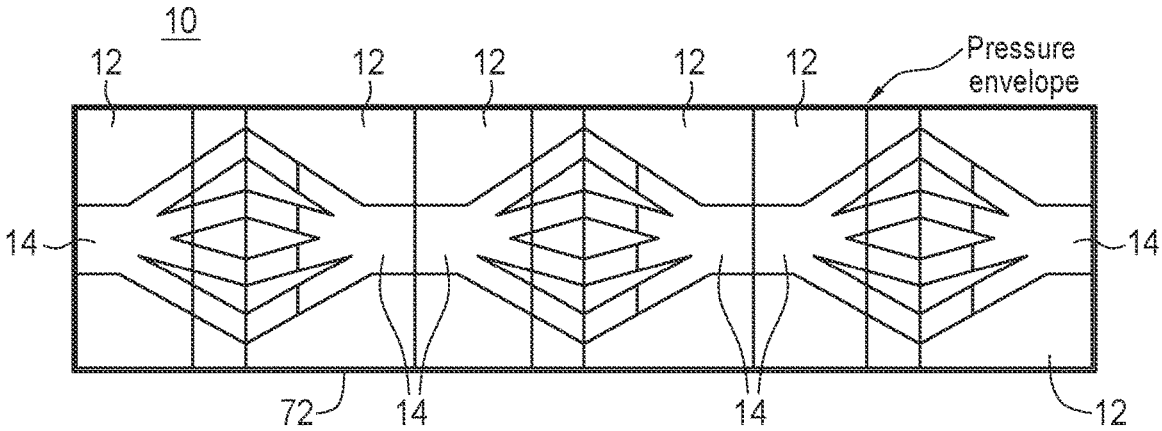
FIG. 17 is a side elevation view depicting an embodiment of a mixing head disposed in a pressure envelope.

Referring to FIG. 17, another embodiment of mixing head 10 is shown. In some embodiments, mixing head 10 can comprise of one or more mixing head sections 12 disposed within a "pressure envelope", meaning, that the mixing head sections can be disposed within production piping 72 that can withstand the pressures of fluids or gases that flow therethrough and, thus, can contain the pressure of fluids or gases passing through mixing head 10.

Figure 18:
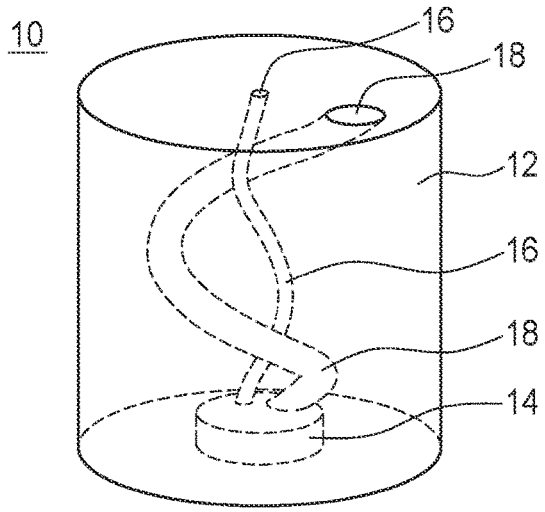
FIG. 18 is a perspective cross-section view depicting an embodiment of a mixing head comprising helical bores disposed therethrough.

Referring to FIG. 18, in some embodiments, mixing head 10 can comprise one or more of central bore 16 and divergent bore(s) 18 disposed in mixing head section following a helical path.

In some embodiments, mixing head sections 12 used to make up mixing head 10 can be manufactured in any number of techniques as well known to those skilled in the art. In some embodiments, mixing head sections 12 can be manufactured by one or more of being cast, being machined and being made through a three dimensional printing process, as well known to those skilled in the art.

Figure 19:
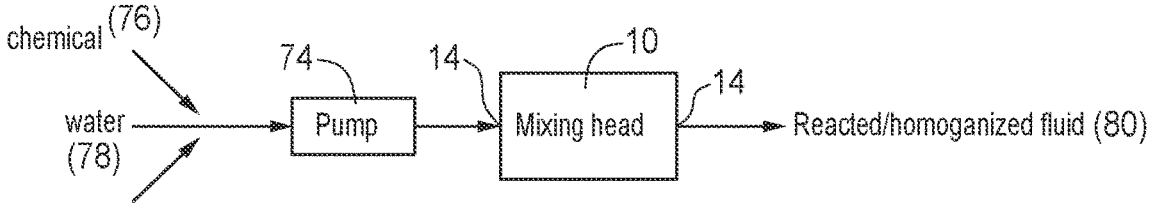
FIG. 19 is a block diagram depicting a first process application using the mixing head of FIG. 1.

Referring to FIG. 19, in some embodiments, mixing head 10 can be used in a process wherein water 78 and chemical 76 can be pumped by pump 74 into an opening 14 of mixing head 10 to be mixed while passing therethrough and exit out of another opening 14 as a reacted or homogenized fluid 80.

Figure 20:
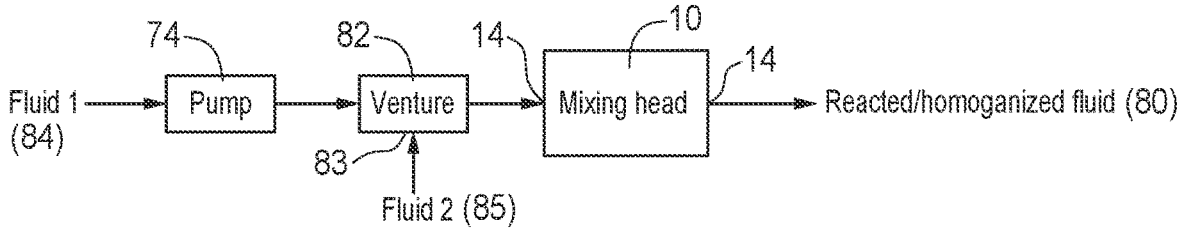
FIG. 20 is a block diagram depicting a second process application using the mixing head of FIG. 1.

Referring to FIG. 20, in some embodiments, mixing head 10 can be used in a process wherein one fluid 84 can be pumped by pump 74 through venturi unit 82 so as to have another fluid 85 to be injected into fluid 84 via injection port 83 before passing through mixing head 10 via an opening 14 to thorough mix the fluids prior to exiting from another opening 14 thereof as a reacted or homogenized fluid 80.

Figure 21:
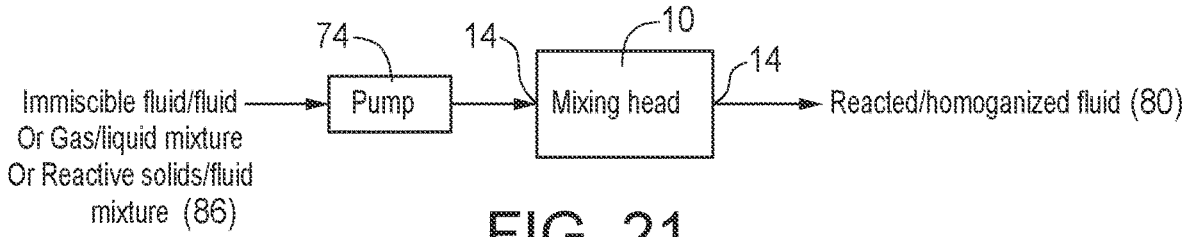
FIG. 21 is a block diagram depicting a third process application using the mixing head of FIG. 1.

Referring to FIG. 21, mixing head 10 can be used in a process wherein a mixture 86 can be pumped by pump 74 into an opening 14 of mixing head 10 to be mixed while passing therethrough and exit out of another opening 14 as a reacted or homogenized fluid 80. Examples of mixture 86 can include immiscible fluids (ie, oil and water), gases and liquids, and solids and liquids.

By passing fluids through mixing head 10, as described above in the various embodiments, the mixing of fluids can be created by the cross shearing of fluid streams arising from the multiple flow paths through the central and divergent bores passing through mixing head 10. The shear can be modified by flow velocity, size of the central and divergent bores, the viscosity of fluids passing therethrough and the interaction of immiscible fluids. Passing two or more sub-components, such as fluids, solids and gases, through mixing head 10 can cause homogenization and mixing of the sub-components as well as chemical reactions or chemical interactions between the sub-components.

In operation, mixing head 10 can be used in the treatment of oily sludge by mixing other fluids or solids into the sludge. As an example, mixing head 10 can be used to mix chemicals (usually in liquid form but can also be in solid or gas form), as well known to those skilled in the art, into the sludge to separate and recover oil from the sludge to be included with produced oil for commercial use. In another example, mixing head 10 can be used to mix chemicals (usually in liquid form but can also be in solid or gas form), as well known to those skilled in the art, to separate and recover oil from recovered drilling fluids used in the drilling of wells as well as being able to recover the chemicals and solids used in drilling fluids for reuse.

Other examples of the uses of mixing head 10 can be in municipal applications, such as flocculation of solids from liquids, treatment of sewage and treatment of freshwater. In other applications, mixing head 10 can be used in the treatment of wastewater by injecting ozone in with effluent. In some embodiments, mixing head 10 can be used as a reaction vessel in addition to being used as a mixing vessel.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A mixing head for mixing substances together, the mixing head comprising:

at least two mixing head sections disposed adjacent to each other within one of a pipe and production piping, wherein each of the at least two mixing head sections further comprises:

an opening disposed on a first side thereof and a planar abutting surface disposed on a second side thereof;

a first bore of a first length disposed along a longitudinal axis through each of the at least two mixing head sections between the opening and the planar abutting surface thereof providing communication therebetween; and a first set of at least one second bore of a second length disposed along a second axis divergent to the longitudinal axis through each of the at least two mixing head sections between the opening and the planar abutting surface thereof providing communication therebetween, wherein the second length is longer than the first length; and wherein the planar abutting surface of one of the at least two mixing head sections is a mirror image of the planar abutting surface of another of the at least two mixing head sections, the planar abutting surfaces configured such that the first bore and the first set of the at least one second bore of the at least two mixing head sections are aligned when the planar abutting surfaces of the at least two mixing head sections are abutted to each other, wherein the opening of a first mixing head section of the at least two abutted mixing head sections defines an inlet of the mixing head, and the opening of a last mixing head section of the at least two abutted mixing head sections defines an outlet of the mixing head.

2. The mixing head as set forth in claim 1, wherein one or both of the first bore and the first set of the at least one second bore comprises one or more cross-sectional shapes along their respective lengths from a group comprising of circles, squares, triangles, rectangles, polygons, ovals, ellipses and irregular shapes.

3. The mixing head as set forth in claim 1, wherein the substances comprises one or more of gases, liquids and solids.

4. The mixing head as set forth in claim 1, wherein the at least two mixing head sections are substantially circular in cross-section.

5. The mixing head as set forth in claim 1, wherein a plurality of the at least one second bore is disposed circumferentially around the first bore.

6. The mixing head as set forth in claim 5, wherein the at least two mixing head sections are substantially circular in cross-section.

7. The mixing head as set forth in claim 1, wherein each of the at least two mixing head sections further comprises a second set of at least one third bore of a third length disposed therethrough between the opening and the planar abutting surface thereof providing communication therebetween, wherein the third length is longer than the second length, and wherein the third length is disposed along a third axis divergent to both the longitudinal axis and the second axis.

8. The mixing head as set forth in claim 7, further comprising a shear plenum section disposed adjacent to the planar abutting surfaces of the at least two mixing head sections, the shear plenum section comprising a plenum therein substantially aligned with the first bore and the first set of the at least one second bore, the shear plenum section comprising at least one shear bore providing communication between the second set of the at least one third bore and the plenum.

9. The mixing head as set forth in claim 8, wherein the at least one shear bore intersects with the plenum at an angle that is substantially perpendicular to the longitudinal axis.

10. The mixing head as set forth in claim 8, wherein the at least one shear bore intersects with the plenum at an angle that is acute to the longitudinal axis.

11. The mixing head as set forth in claim 7, further comprising the at least two mixing head sections disposed in a side by side configuration where the planar abutting surface of one of the least two mixing head sections is aligned with the planar abutting surface of another of the at least two mixing head sections, and further comprising a plenum disposed therebetween the at least two mixing head sections.

12. The mixing head as set forth in claim 1, wherein a cross-sectional area of the at least one second bore varies as the at least one second bore traverses from the inlet to the second side.

13. The mixing head as set forth in claim 1, wherein the first set of the at least one second bore follows an axis that is askew to the longitudinal axis by an angle.

14. The mixing head as set forth in claim 13, wherein the angle is less than or equal to 10°.

15. The mixing head as set forth in claim 1, wherein one or both of the first bore and the first set of the at least one second bore comprises rifle lands disposed therealong.

16. The mixing head as set forth in claim 1, further comprising a venturi section disposed between the at least two mixing head sections, the venturi section comprising an annular gap for providing communication between the at least two mixing head sections, the venturi section further comprising at least one injection port providing communication between the annular gap and a second source of the substances to be injected into the mixing head.

17. The mixing head as set forth in claim 1, further comprising wear surface coating disposed at least partially on surfaces within the opening and within the first set of the at least one second bore.

18. The mixing head as set forth in claim 1, further comprising at least two of the first set of the at least one second bore at least partially intersecting with each other within the mixing head section.

19. The mixing head as set forth in claim 1, further comprising at least two sets of the at least two mixing head sections disposed in a side-by-side configuration.

20. The mixing head as set forth in claim 19, further comprising an insert section disposed in between a pair of the at least two sets of the at least two mixing head sections.

21. The mixing head as set forth in claim 20, wherein the insert section further comprises at least one injection port providing communication between the annular gap and a second source of the substances to be injected into the mixing head.

22. The mixing head as set forth in claim 1, wherein one or both of the first bore and the first set of the at least one second bore comprises a helical configuration.

23. A method for mixing substances together, the method comprising the steps of:

receiving a mixing head configured for passing the substances through, the mixing head comprising at least two mixing head sections disposed adjacent to each other within one of a pipe and production piping, wherein each of the two mixing head sections further comprises:

an opening disposed on a first side thereof and a planar abutting surface disposed on a second side thereof, a first bore of a first length disposed along a longitudinal axis through each of the at least two mixing head sections between the opening and the planar abutting surface thereof providing communication therebetween, and a first set of at least one second bore of a second length disposed along a second axis askew to the longitudinal axis through each of the at least two mixing head sections between the opening and the planar abutting surface thereof providing communication therebetween, wherein the second length is longer than the first length, and wherein the planar abutting surface of one of the at least two mixing head sections is a mirror image of the planar abutting surface of another of the at least two mixing head sections, the planar abutting surfaces configured such that the first bore and the at least one second bore of the at least two mixing head sections are aligned when the planar abutting surfaces of the at least two mixing head sections are abutted to each other, wherein the opening of a first mixing head section of the at least two abutted mixing head sections defines an inlet of the mixing head, and the opening of a last mixing head section of the at least two abutted mixing head sections defines an outlet of the mixing head;

pumping the substances into the inlet; and receiving mixed substances from the outlet.

24. The method as set forth in claim 23, wherein each of the at least two mixing head sections further comprises a second set of at least one third bore of a third length disposed therethrough between the opening and the planar abutting surface thereof providing communication therebetween, wherein the third length is longer than the second length, and wherein the third length is disposed along a third axis askew to both the longitudinal axis and the second axis.

25. The method as set forth in claim 24, further comprising the step of passing the mixed substances through a shear plenum section comprising a plenum therein substantially aligned with the first bore and the first set of the at least one second bore, the shear plenum section comprising at least one shear bore providing communication between the second set of the at least one third bore and the plenum.

26. The method as set forth in claim 25, wherein the at least one shear bore intersects with the plenum at an angle that is substantially perpendicular to the longitudinal axis.

27. The method as set forth in claim 25, wherein the at least one shear bore intersects with the plenum at an angle that is acute to the longitudinal axis.

28. The method as set forth in claim 23, further comprising the step of pumping the substances through a venturi section before entering the inlet, and injecting a second source of the substances into the venturi section.

29. The method as set forth in claim 23, wherein the substances comprises one or more of gases, liquids and solids.

30. The method as set forth in claim 23, wherein the at least two mixing head sections comprise a two-dimensional cross-section.

31. The method as set forth in claim 30, wherein the at least two mixing head sections are substantially circular in cross-section.

32. The method as set forth in claim 23, wherein a plurality of the at least one second bore is disposed circumferentially around the first bore.

* * * * *